US011338180B2

(12) United States Patent
Boggs

(10) Patent No.: US 11,338,180 B2
(45) **Date of Patent: *May 24, 2022**

(54) GOLF CLUB HEAD WITH POLYMERIC INSERT

(71) Applicant: KARSTEN MANUFACTURING CORPORATION, Phoenix, AZ (US)

(72) Inventor: Joshua Boggs, Aledo, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/950,664

(22) Filed: Nov. 17, 2020

(65) Prior Publication Data

US 2021/0138315 A1 May 13, 2021

Related U.S. Application Data

(63) Continuation of application No. 16/590,251, filed on Oct. 1, 2019, now Pat. No. 10,850,174, which is a continuation of application No. 16/169,705, filed on Oct. 24, 2018, now Pat. No. 10,463,931, which is a continuation of application No. 15/904,540, filed on Feb. 26, 2018, now abandoned, which is a continuation of application No. 15/162,658, filed on May 24, 2016, now Pat. No. 9,931,548, which is a (Continued)

(51) Int. Cl.

| | |
|---|---|
| ***A63B 53/06*** | (2015.01) |
| ***A63B 53/04*** | (2015.01) |
| ***A63B 60/02*** | (2015.01) |
| *A63B 71/06* | (2006.01) |
| *A63B 60/54* | (2015.01) |
| *A63B 53/02* | (2015.01) |

(52) U.S. Cl.

CPC ..... *A63B 53/0466* (2013.01); *A63B 60/02* (2015.10); *A63B 53/023* (2020.08); *A63B 53/042* (2020.08); *A63B 53/045* (2020.08); *A63B 53/0408* (2020.08); *A63B 53/0433* (2020.08); *A63B 53/0437* (2020.08); *A63B 53/06* (2013.01); *A63B 60/54* (2015.10); *A63B 2053/0491* (2013.01); *A63B 2071/0694* (2013.01); *A63B 2209/00* (2013.01); *A63B 2209/02* (2013.01)

(58) Field of Classification Search

CPC ..... A63B 53/0408; A63B 53/045; A63B 2053/0491; A63B 53/0466; A63B 60/02; A63B 53/06; A63B 60/54; A63B 53/0344; A63B 53/0437; A63B 2209/00; A63B 2209/02; A63B 53/0433

USPC ..... 473/343, 345, 347, 348, 349, 336

See application file for complete search history.

(56) References Cited

U.S. PATENT DOCUMENTS

| | | | |
|---|---|---|---|
| 4,241,115 | A | 12/1980 | Temin |
| 5,967,903 | A | 10/1999 | Cheng |
| 6,478,690 | B2 | 11/2002 | Helmstetter et al. |

(Continued)

*Primary Examiner* — Benjamin Layno

(57) ABSTRACT

A golf club head includes a first portion joined to a second portion to at least partially define an interior club head volume. The first portion includes a wall defining an outer boundary of the club head volume, and a support rib extending from the wall to operatively stiffen the first portion. The second portion of the golf club head can engage the support rib, and the support rib can be adhered to the second portion to join the first portion and the second portion.

17 Claims, 6 Drawing Sheets

Related U.S. Application Data continuation-in-part of application No. 14/493,400, filed on Sep. 23, 2014, now Pat. No. 9,358,432.

(60) Provisional application No. 62/015,092, filed on Jun. 20, 2014.

(56) References Cited

U.S. PATENT DOCUMENTS 6,648,772 B2 11/2003 Vincent et al.
6,890,267 B2 5/2005 Mahaffey et al.
7,108,609 B2 9/2006 Stites et al.
7,354,355 B2 4/2008 Tavares et al.
7,419,441 B2 9/2008 Hoffman et al.
7,470,201 B2 12/2008 Nakahara
7,628,711 B2 12/2009 Akinori
7,704,155 B2 4/2010 Bennett
7,927,231 B2 4/2011 Sato et al.
7,938,739 B2 5/2011 Cole
7,988,568 B2 8/2011 Stites et al.
8,062,151 B2 11/2011 Boyd et al.
8,182,364 B2 5/2012 Cole
8,235,843 B1 8/2012 Rice et al.
8,409,031 B2 4/2013 Stites et al.
8,435,135 B2 5/2013 Stites et al.
8,579,724 B2 11/2013 Evans
8,591,352 B2 11/2013 Hirano
8,657,702 B2 2/2014 Boyd et al.
8,777,774 B1 7/2014 Kim
8,814,722 B2 8/2014 Stites et al.
8,951,145 B2 2/2015 Bezilla et al.
8,992,339 B2 3/2015 Matsunaga
9,072,949 B2 7/2015 Stites et al.
9,079,368 B2 7/2015 Tavares et al.
9,211,452 B2 12/2015 Bennett et al.
9,381,406 B2 7/2016 Boggs
9,731,171 B2 8/2017 Boggs
9,931,548 B2 4/2018 Boggs
10,463,931 B2 11/2019 Boggs
10,850,174 B2 * 12/2020 Boggs ..... A63B 53/0466
2002/0137576 A1 9/2002 Dammen
2003/0125129 A1 7/2003 Saksun, Sr.
2004/0005936 A1 * 1/2004 Imamoto ..... A63B 60/02 473/344
2008/0132353 A1 6/2008 Hsiao
2011/0294589 A1 * 12/2011 Stites ..... A63B 53/08 473/290
2012/0135819 A1 5/2012 Uetz
2013/0109503 A1 * 5/2013 Matsunaga ..... A63B 60/00 473/346
2013/0130829 A1 5/2013 Bennett
2016/0346630 A1 12/2016 Sander

* cited by examiner

GOLF CLUB HEAD WITH POLYMERIC INSERT

CROSS REFERENCE TO RELATED APPLICATIONS

This is a continuation of U.S. patent application Ser. No. 16/590,251, filed Oct. 1, 2019, now U.S. Pat. No. 10,850,174 which is a continuation of U.S. patent application Ser. No. 16/169,705, filed Oct. 24, 2018, now U.S. Pat. No. 10,463,931, issued Nov. 5, 2019, which is a continuation of U.S. patent application Ser. No. 15/904,540, filed Feb. 26, 2018, which is a continuation of U.S. patent application Ser. No. 15/162,658, filed May 24, 2016, now U.S. Pat. No. 9,931,548, which is a continuation-in-part of U.S. patent application Ser. No. 14/493,400, filed on Sep. 23, 2014, now U.S. Pat. No. 9,358,432, which claims the benefit of priority from U.S. Provisional Patent Application No. 62/015,092, filed Jun. 20, 2014. These references are hereby incorporated by reference in their entirety.

TECHNICAL FIELD

The present invention relates generally to golf clubs and golf club heads, and, in particular, to golf clubs and golf club heads that include polymeric portions.

BACKGROUND

A golf club is generally formed by affixing a club head to a first end of a flexible shaft, and affixing a grip member to a second end of the shaft. Convention and the USGA Rules of Golf have established certain terminology to describe different portions and angular relationships of a club head. For example, a wood-type club head includes a face or striking face, a crown, a sole, a heel, a toe, a back, and a hosel. These club head portions are most easily described when the club head is positioned in a reference position relative to a ground plane. In the reference position, the lie angle of the club (i.e., the angle formed between the shaft and the ground plane) and the loft angle of the club (i.e., the angle formed between the face and the ground plane) are oriented as specified by the manufacturer.

The sole of the club head is generally disposed on an opposite side of the club head from the crown, and is further disposed on an opposite side of the club head from the shaft. When in the reference position, the sole of the club head is intended to contact the ground plane. For the portion of the club that is to the rear of the face, the crown may be separated from the sole at the point on the club head where the surface tangent of the club head is normal to the ground plane.

The hosel is the portion of the club head that is intended to couple the club head with the shaft. The hosel includes an internal bore that is configured to receive the shaft or a suitable shaft adapter. In a configuration where the shaft is directly inserted into the hosel, the hosel bore may have a center hosel-axis that is substantially coincident with a center longitudinal-axis of the shaft. For club head embodiments including a shaft adapter, the shaft may be received in a suitable shaft adapter bore that has a center adapter-axis, which may be substantially coincident with the shaft axis. The shaft adapter-axis may be offset angularly and/or linearly from the hosel-axis to permit adjustment of club parameters via rotation of the shaft adapter with respect to club head, as is known by persons skilled in the art.

The heel may be defined as the portion of the club head that is proximate to and including the hosel. Conversely, the toe may be the area of the golf club that is the farthest from the shaft. Finally, the back of the club head may be the portion of the club head that is generally opposite the face.

Two key parameters that affect the performance and forgiveness of a club include the magnitude and location of the club head's center of gravity (COG) and the various moments of inertia (MOI) about the COG. The club's moments of inertia relate to the club's resistance to rotation (particularly during an off-center hit). These are often perceived as the club's measure of "forgiveness." In typical driver designs, high moments of inertia are desired to reduce the club's tendency to push or fade a ball. Achieving a high moment of inertia generally involves placing mass as close to the perimeter of the club as possible (to maximize the moment of inertia about the center of gravity), and as close to the toe as possible (to maximize a separate moment of inertia about the shaft).

While the various moments of inertia affect the forgiveness of a club head, the location of the center of gravity can also affect the trajectory of a shot for a given face loft angle. For example, a center of gravity that is positioned as far rearward (i.e., away from the face) and as low (i.e., close to the sole) as possible typically results in a ball flight that has a higher trajectory than a club head with a center of gravity placed more forward and/or higher.

While a high moment of inertia is obtained by increasing the perimeter weighting of the club head, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

The desire for a faster swing speed (i.e., lower mass) and greater forgiveness (i.e., larger MOI or specifically placed COG) presents a difficult optimization problem. These competing constraints explain why most drivers/woods are formed from hollow, thin-walled bodies, with nearly all of the mass being positioned as far from the COG as possible (i.e., to maximize the various MOI's). Additionally, removable/interchangeable weights have been used to alter other dynamic, swing parameters and/or to move the COG. Therefore, the total of all club head mass is the sum of the total amount of structural mass and the total amount of discretionary mass. Typical driver designs generally have a total club head mass of from about 195 g to about 215 g.

Structural mass generally refers to the mass of the materials that are required to provide the club head with the structural resilience needed to withstand repeated impacts. Structural mass is highly design-dependant, and provides a designer with a relatively low amount of control over specific mass distribution.

Discretionary mass is any additional mass (beyond the minimum structural requirements) that may be added to the club head design for the sole purpose of customizing the performance and/or forgiveness of the club. In an ideal club design, for a constant total swing weight, the amount of structural mass would be minimized (without sacrificing resiliency) to provide a designer with additional discretionary mass to customize club performance.

While this provided background description attempts to clearly explain certain club-related terminology, it is meant to be illustrative and not limiting. Custom within the industry, rules set by golf organizations such as the United States Golf Association (USGA) or the R&A, and naming convention may augment this description of terminology without departing from the scope of the present application.

SUMMARY

A golf club head includes a first portion joined to a second portion to at least partially define an interior club head volume. The first portion includes a wall defining an outer boundary of the club head volume, and a support rib extending from the wall to operatively stiffen the first portion. The second portion of the golf club head defines a slot that receives a portion of the support rib, and the support rib is adhered within the slot to join the first portion and the second portion.

In some embodiments, the first portion and second portion may define a lap joint therebetween. The first portion and second portion may be further adhered together at the lap joint, which may be at an angle to a plane containing the support rib. The present invention provides a manner of constructing a multi-piece club head that has improved bonding between the joined components. These techniques may be particularly useful when bonding certain polymeric materials that have low surface energies and are traditionally difficult to adhere.

The above features and advantages and other features and advantages of the present invention are readily apparent from the following detailed description of the best modes for carrying out the invention when taken in connection with the accompanying drawings.

DETAILED DESCRIPTION

The present technology generally relates to a golf club head that is formed by joining a first portion to a second portion to at least partially define an interior volume of the club head. The two portions are joined together with the aid of a support rib that extends between the two portions to both stiffen the club head and to promote adhesion between the portions. This head design may be particularly useful in a wood-style head, such as a driver, fairway wood, or hybrid iron.

Figure 1:
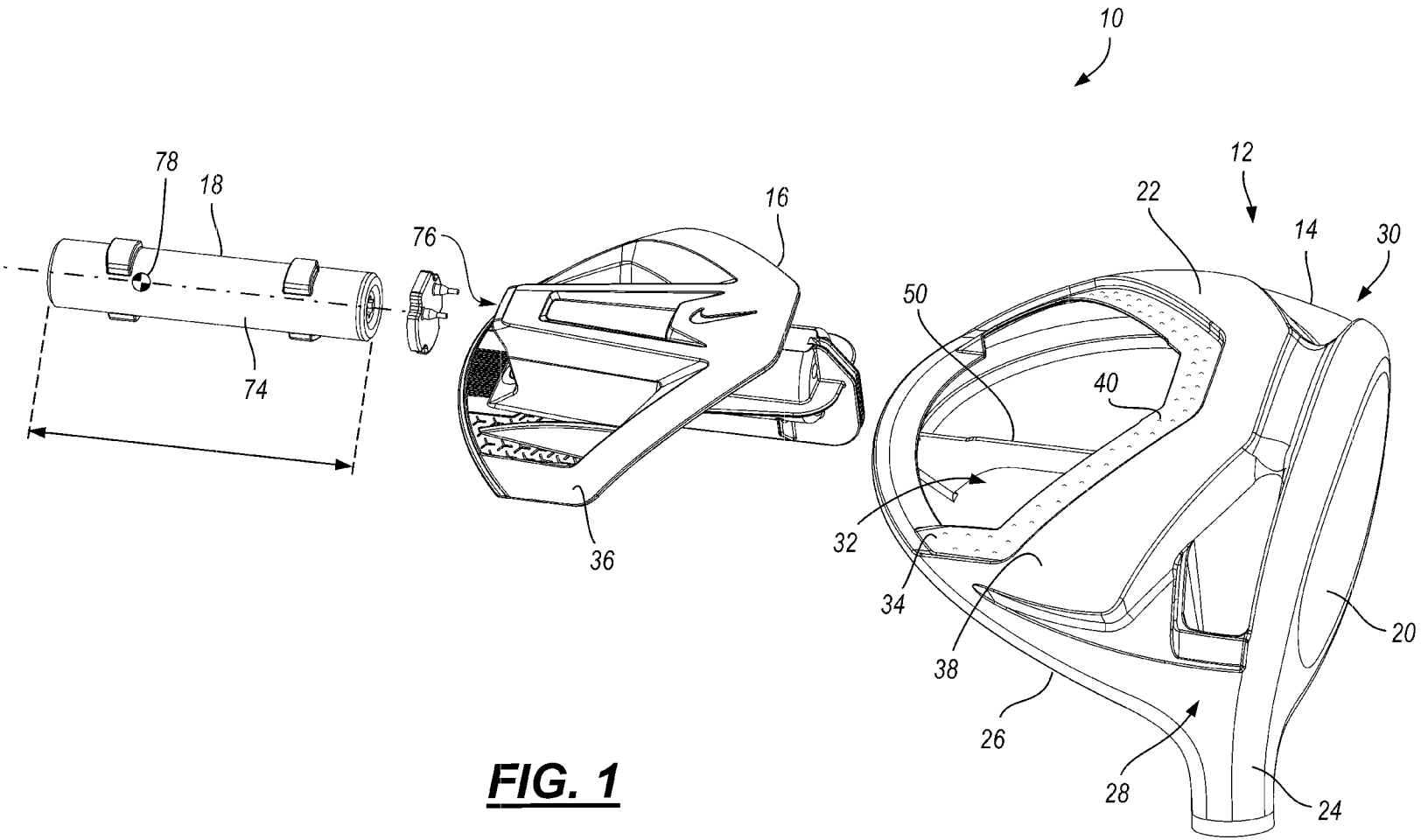
FIG. 1 is a schematic exploded perspective view of a golf club head having a polymeric insert.

Referring to the drawings, wherein like reference numerals are used to identify like or identical components in the various views, FIGS. 1-8 schematically illustrate a first embodiment of the present design. Specifically, FIG. 1 illustrates an exploded perspective view 10 of a golf club head 12 that includes a first, body portion 14 ("body 14") and a second, insert portion 16 ("insert 16"). The body 14 and insert 16 may be secured together to define a closed, interior club head volume. Additionally, one or more weights 18 may be selectively coupled with the body 14 and/or insert 16 to provide a user with an ability to alter the stock performance and weight distribution of the club head 12.

As shown, the body 14 includes a face 20, a sole 22, a hosel 24, and a crown 26 (i.e., where the crown 26 is disposed on an opposite side of the club head 12 from the sole 22). A heel portion 28 may generally be defined on a first side of the face 20, and may include the hosel 24. Likewise, a toe portion 30 may generally be defined on an opposite side of the face 20 from the heel portion 28.

The body 12 may be formed through any suitable manufacturing process that may be used to form a substantially hollow body. In the illustrated embodiment, the body 14 may be formed from a metal alloy using processes such as stamping, casting, molding, and/or forging. The body 14 may be either a single unitary component, or may comprise various subcomponents that may subsequently be fused together. Examples of suitable light-weight metal alloys may include, for example, stainless steel (e.g., AISI type 304 or AISI type 630 stainless steel), titanium alloys (e.g., a Ti-6Al-4V or Ti-8Al-1Mo-1V Titanium alloy), amorphous metal alloys, or other similar materials.

Figure 2:
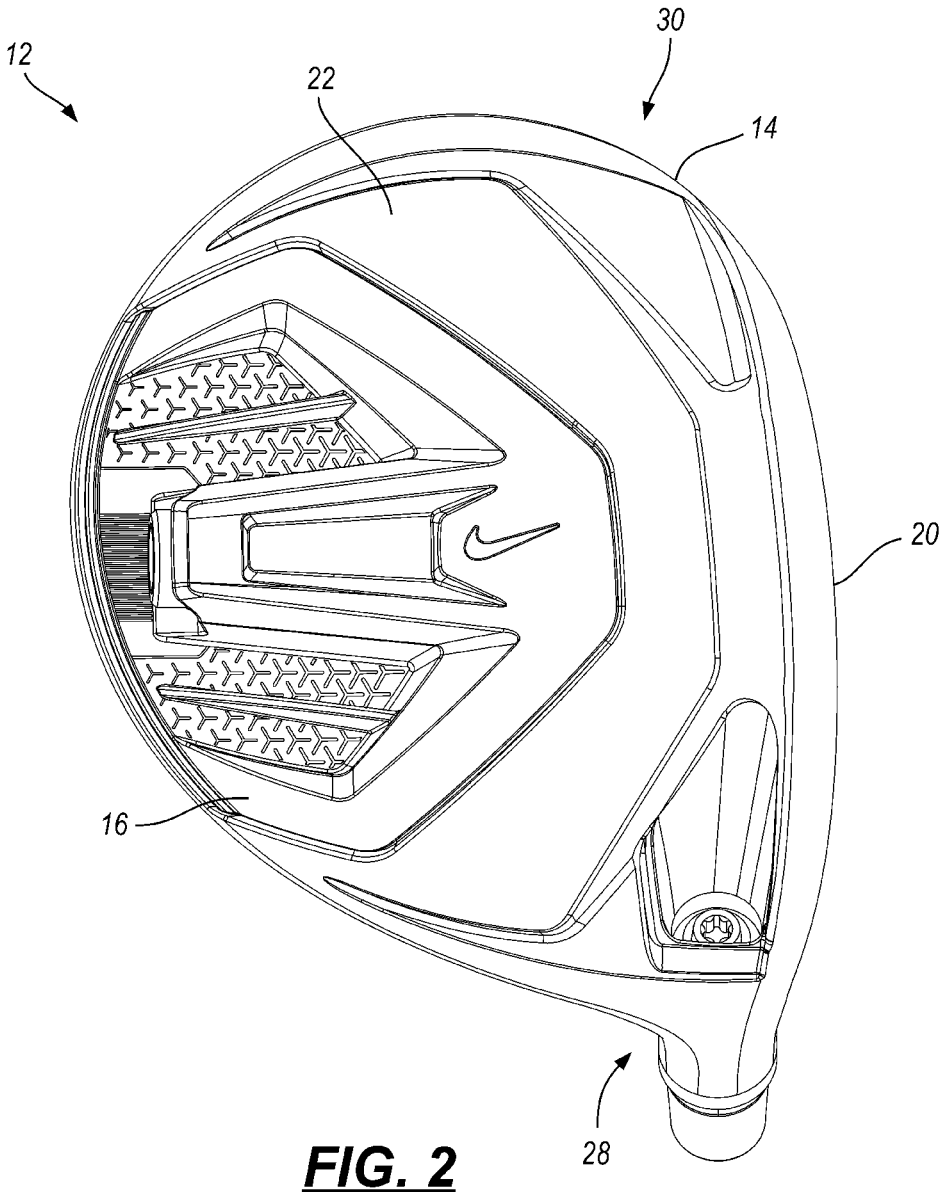
FIG. 2 is a schematic bottom view of the golf club head provided in FIG. 1.

The body 14 may define an opening 32 that is adapted to receive the insert 14. In one configuration, the opening 32 may be provided entirely in the sole 22, however, in other configurations, the opening 32 may also extend to include a portion of the crown 26. As generally shown in FIG. 2, the insert 16 may be secured to the body 14 such that it entirely covers the opening 32.

To reduce structural mass beyond what is economically viable with metal alloys, the insert 16 may be formed from a polymeric material that is affixed to the body 14 in a manner to withstand repeated shock/impact loadings. The comparatively low density nature of polymeric materials also permits greater design flexibility, at less of a structural weight penalty, than similar designs made from metal. In one configuration, the desired design flexibility may be achieved by molding the polymeric material into shape using a molding technique, such as, injection molding, compression molding, blow molding, thermoforming or the like. To provide the maximum design flexibility, the preferred molding technique is injection molding.

While weight savings and design flexibility are important, the polymeric material must still be strong enough to withstand the stress that is experienced when the club head 12 impacts a ball. This may be accomplished through a combination of structural and material design choices. With regard to material selection, it is preferable to use a moldable polymeric material that has a tensile strength of greater than about 180 MPa (according to ASTM D638), or more preferably greater than about 220 MPa.

In one embodiment, the insert 16 may be formed from a polymeric material that comprises a resin and a plurality of discontinuous fibers (i.e., "chopped fibers"). The discontinuous/chopped fibers may include, for example, chopped carbon fibers or chopped glass fibers and are embedded within the resin prior to molding the insert 16. In one configuration, the polymeric material may be a "long fiber thermoplastic" where the discontinuous fibers are embedded in a thermoplastic resin and each have a designed fiber length of from about 3 mm to about 12 mm. In another configuration, the polymeric material may be a "short fiber thermoplastic" where the discontinuous fibers are similarly embedded in a thermoplastic resin, though may each have a designed length of from about 0.01 mm to about 3 mm. In either case, the fiber length may be affected by the molding process, and due to breakage, a portion of the fibers may be shorter than the described range. Additionally, in some configurations, discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, the material may have fibers with lengths of from about 0.01 mm to about 12 mm and a resin content of from about 40% to about 90% by weight, or more preferably from about 55% to about 70% by weight.

One suitable material may be a thermoplastic polyamide (e.g., PA6 or PA66) filled with chopped carbon fiber (i.e., a carbon-filled polyamide). Other resins may include certain polyimides, polyamide-imides, polyetheretherketones (PEEK), polycarbonates, engineering polyurethanes, and/or other similar materials.

By replacing a portion of the body 14 with a comparatively lighter polymeric insert 16, either the entire weight of the club head 12 may be reduced (which may provide faster club head speeds and/or longer hitting distances), or alternatively, the ratio of discretionary weight to structural weight may be increased (i.e., for a constant club head weight). Additionally, because polymeric molding techniques are generally capable of forming more intricate and/or complex designs than traditional metal forming techniques, the use of a polymeric insert 16 may also provide greater freedom in styling the overall appearance of the club head.

Referring again to FIG. 1, the insert 16 may be affixed to the body 14 of the club head 12 using an adhesive that is selected to bond with both the metal body 14 and the polymer of the insert 16. Such an adhesive may include, for example, a two-part acrylic epoxy such as DP-810, available from the 3M Company of St. Paul, Minn. The adhesive may be disposed across a lap joint formed between the insert 16 and an outer bond surface 34 of the body 14 when assembled. In one configuration, the outer bond surface 34 may be at least partially recessed into the body 14 such that when the insert 16 is installed, an outer surface 36 of the insert 16 may either be substantially flush with an outer surface 38 of the sole 22, or else may be partially recessed relative to the outer surface 38 of the sole 22.

In one configuration, the bond surface 34 of the lap joint may include a plurality of embossed spacing features 40 disposed in a spaced arrangement across the surface 34. The spacing features 40 may include one or more bumps or ridges that are provided to ensure a uniform, minimum adhesive thickness between the body 14 and the insert 16. In one configuration, each of the plurality of spacing features 40 may protrude above the bond surface 34 by about 0.05 mm to about 0.50 mm.

While most adhesives will readily bond to metals, typical bond strengths to polymers are comparatively lower. To improve the adhesive bonding with the polymer of the insert 16, the insert 16 may be pre-treated prior to assembly. In one configuration, such a pre-treatment may include a corona discharge or plasma discharge surface treatment, which may increase the surface energy of the polymer. In other embodiments, chemical adhesion promoters and/or mechanical abrasion may alternatively be used to increase the bond strength with the polymer.

While providing an opening 32 in the body 14 serves to reduce the weight of the club head 12, it also can negatively affect the structural integrity and/or durability of the club head 12 if not properly reinforced. Any flexure of the body 14 around the opening 32 may, for example, negatively affect the bond strength of the adhesive used to secure the insert 16 and/or the performance and durability of the club head 12. To replace some or all of the lost structural rigidity, one or more support struts or ribs 50 may extend across the opening 32 to stiffen the body structure.

Figure 3:
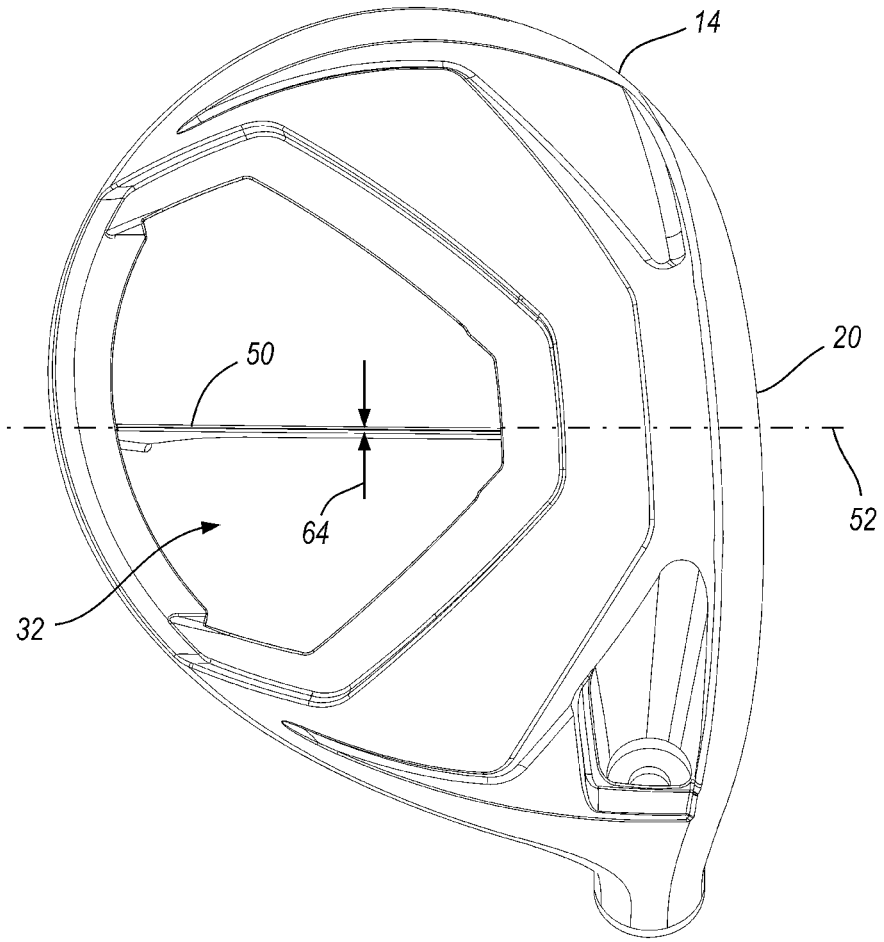
FIG. 3 is a schematic bottom view of a metallic body of a golf club head.

FIG. 3 schematically illustrates a club head body 14 with a single support strut/rib 50 extending across the opening 32. In this configuration, the strut 50 may be generally oriented along a longitudinal axis 52 that intersects the face 20 of the club head 12 (more clearly illustrated in FIG. 5). As used herein, when an axis "intersects" the face, it should be understood that the axis is not constrained to exist only on the described component, but instead extends linearly beyond the component as well.

Figure 4:
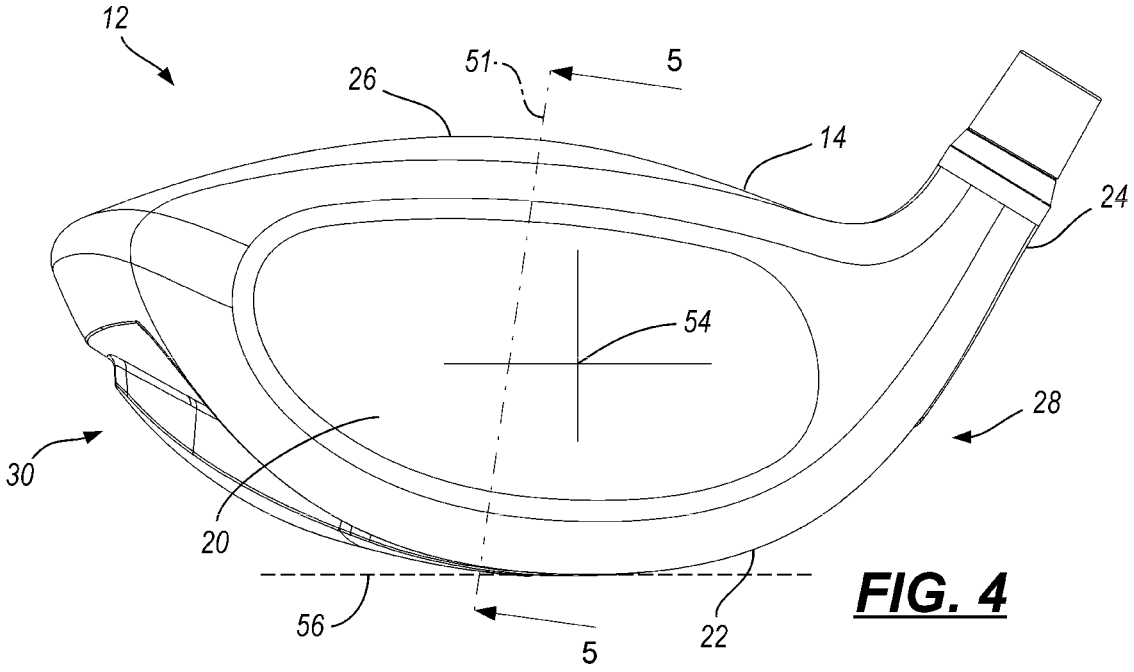
FIG. 4 is a schematic side view of the face of a golf club head.
Figure 5:
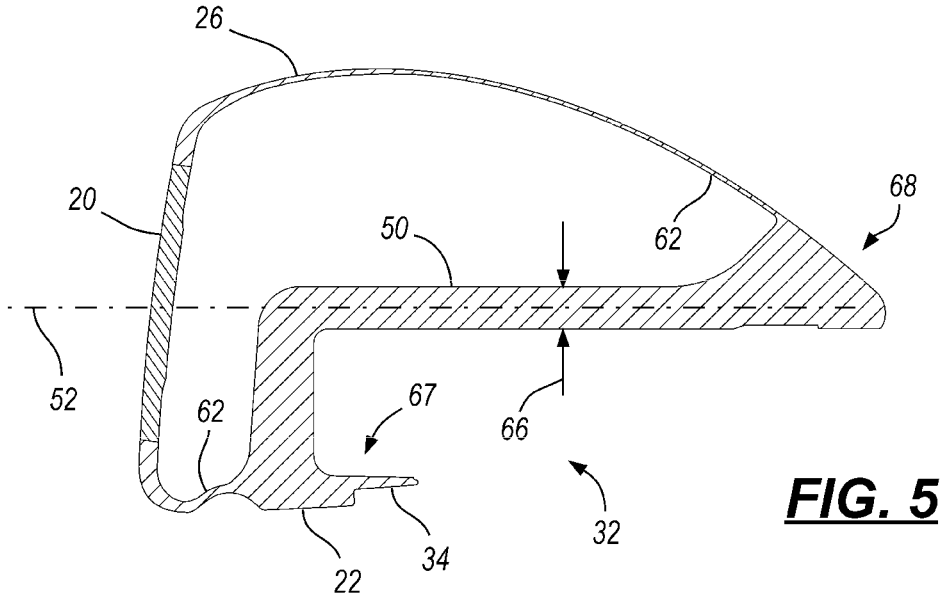
FIG. 5 is a schematic cross-sectional view of the golf club head of FIG. 4, taken along line 5-5.

FIG. 4 provides a face-view of the club head 12 provided in FIG. 3, with a bisecting strut-section taken along line 5-5, which is separately illustrated as FIG. 5. As shown in FIGS. 3-5, the strut 50 may be generally planar in nature, with the majority of the strut 50 being centered about and/or disposed within a common stiffening plane 51. In the illustrated embodiment, the stiffening plane is coincident with section 5-5 shown in FIG. 4. In one configuration, the stiffening plane 51 (and strut 50) may be about perpendicular to the wall of the club head 12 from which the strut/rib 50 extends. In other embodiments, the stiffening plane 51 may be disposed at an angle to the wall, or, for example, within 45 degrees of perpendicular. Said another way, the stiffening plane 51 may form an angle of from about 45 degrees to about 135 degrees with the wall from which the strut 50 extends. As shown in FIG. 4, in some configurations, the strut 50 may be offset relative to a face center 54, and may further be angled relative to a vertical plane (i.e., a plane that is perpendicular to the ground plane 56) extending through the face center 54 (i.e. face center as determined using Unites States Golf Association (USGA) standard measuring procedures and methods). In one configuration, the offset may be from about 0 mm to about 20 mm. Additionally, the angle formed between the strut 50 and the vertical plane may be from about 0 degrees to about 10 degrees.

Referring to FIG. 5, in one configuration, the strut 50 extends from an inner surface 62 of the body 14 on opposing sides of the opening 32. To provide the maximum stiffening and durability to the club head 12, the strut 50 should be integrally attached to the wall, such as by being welded in place, molded/comolded in place, or cast in place. In one configuration the strut 50 may be formed from a metal sheet having a uniform thickness 64 of from about 0.5 mm to about 1.5 mm (shown in FIG. 3), and a height 66 of from about 4 mm to about 25 mm. As generally shown in FIG. 5, while the strut 50 may be secured to the inner surface 62 of the sole 22 at a first end 67, in one embodiment it may be secured to the crown 26 at the opposing end 68 or at various places along its length.

Figure 6:
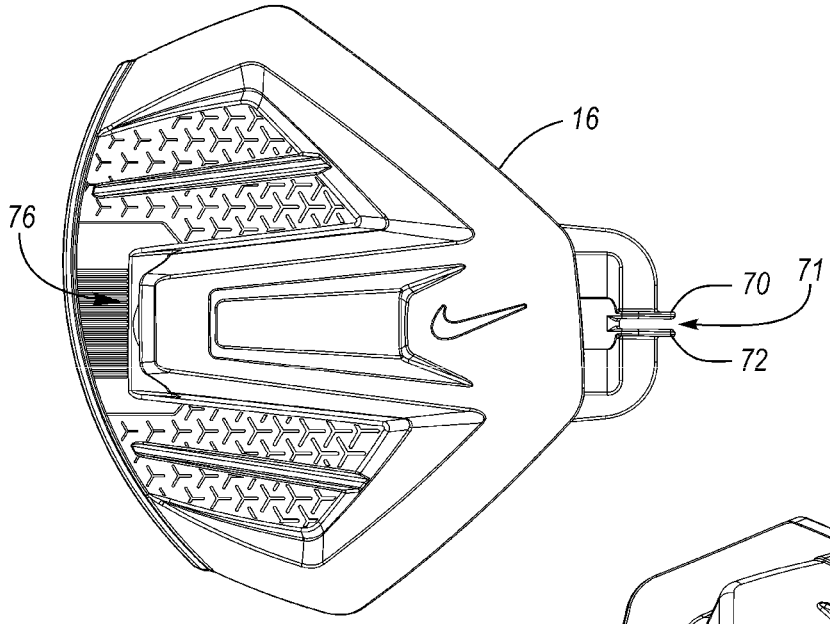
FIG. 6 is a schematic top view of an insert that is configured to be disposed in an opening provided in a body of a golf club head.
Figure 7:
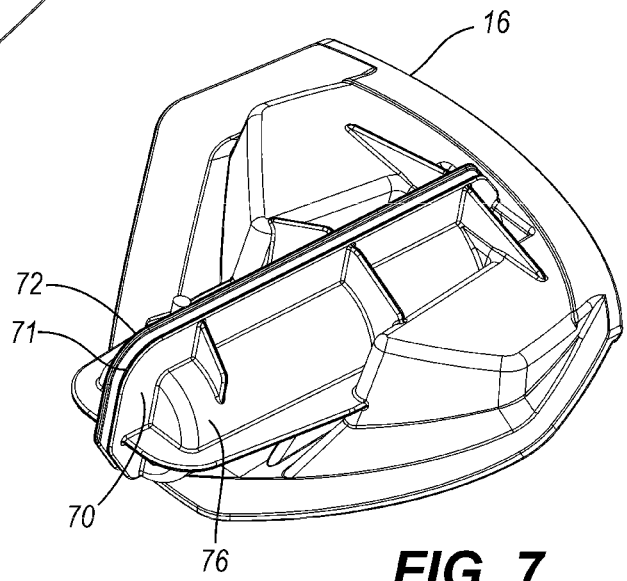
FIG. 7 is a schematic perspective view of the underside of the insert provided in FIG. 6.
Figure 8:
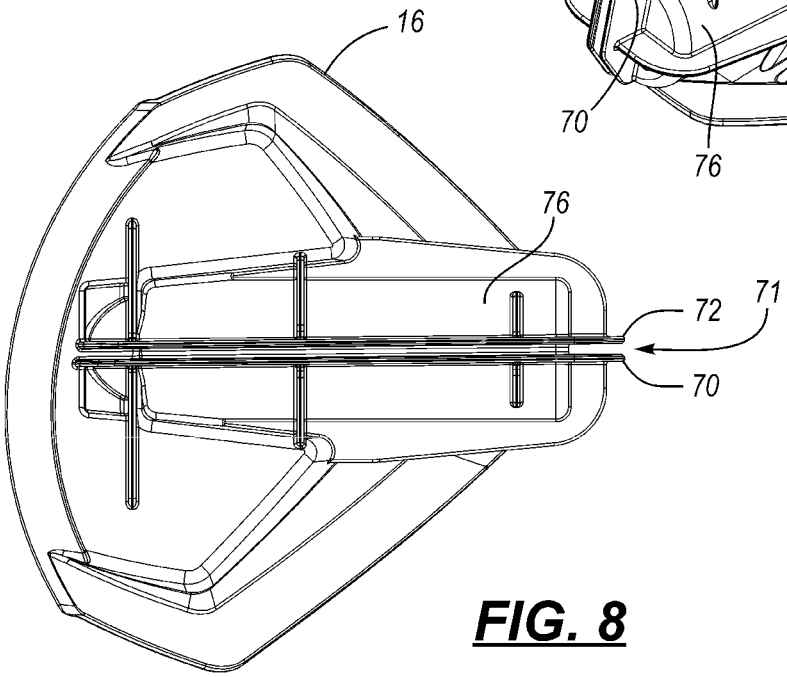
FIG. 8 is a schematic bottom view of the insert provided in FIG. 6.

In addition to stiffening the body structure, the support strut 50 may also assist in securing the insert 16 to the body 14. As shown in FIGS. 6-8, one embodiment of the insert 16 may include two, protruding walls 70, 72 that are spaced apart from each other to define a slot 71. The slot 71 is configured or dimensioned to receive a portion of the strut 50 when the two portions of the club head 12 are assembled/brought into close contact. The slot 71 may be further configured or dimensioned so that the strut 50 may be adhered to each of the walls 70, 72 once it is positioned within the slot 71.

In the illustrated embodiment, the slot 71 may have a uniform width of, for example, from about 1.0 mm to about 2.0 mm. When the insert 16 is assembled with the body 14 and is in close contact with the bond surface 34, the protruding walls 70, 72 extend on opposing sides of the strut 50 and generally parallel to the stiffening plane 51. The inward-facing surfaces of these walls 70, 72 may be adhered to the strut 50 using, for example, the same adhesive that is used to secure the insert 16 to the outer bond surface 34. By adhering the insert 16 to both the strut 50 and the outer bond surface 34 of the body 14, the total surface area that is bonded between the insert 16 and the body 14 may be increased by more than about 30% above the outer bond surface 34, alone. Additionally, securing the insert 16 in this manner utilizes both the sheer strength of the adhesive (via the strut 50) and the tensile/peel strength of the adhesive (via the bond surface 34).

As mentioned above, one or more weights 18 may be selectively coupled with the body 14 and/or insert 16 to provide a user with an ability to alter the stock performance and weight distribution of the club head 12. As generally shown in FIG. 1, in one configuration, the weight 18 may generally include an elongate member 74 that may be removably secured within the golf club head 12. The weight 18 may be received and selectively retained within a bore 76 provided within the insert 16. To properly reinforce the bore 76, particularly if the insert 16 is formed from a polymeric material, the slot 71 may be positioned such that the stiffening plane (defined by the strut 50) bisects the bore and/or weight 18. In a more preferred design, the stiffening plane would be oriented such that the plane intersects the center of gravity 78 of the weight, and any resultant impact force vectors would be within/parallel to the stiffening plane 51. Such a design may minimize any moments that may be applied through the polymer or lap joint.

Figure 9:
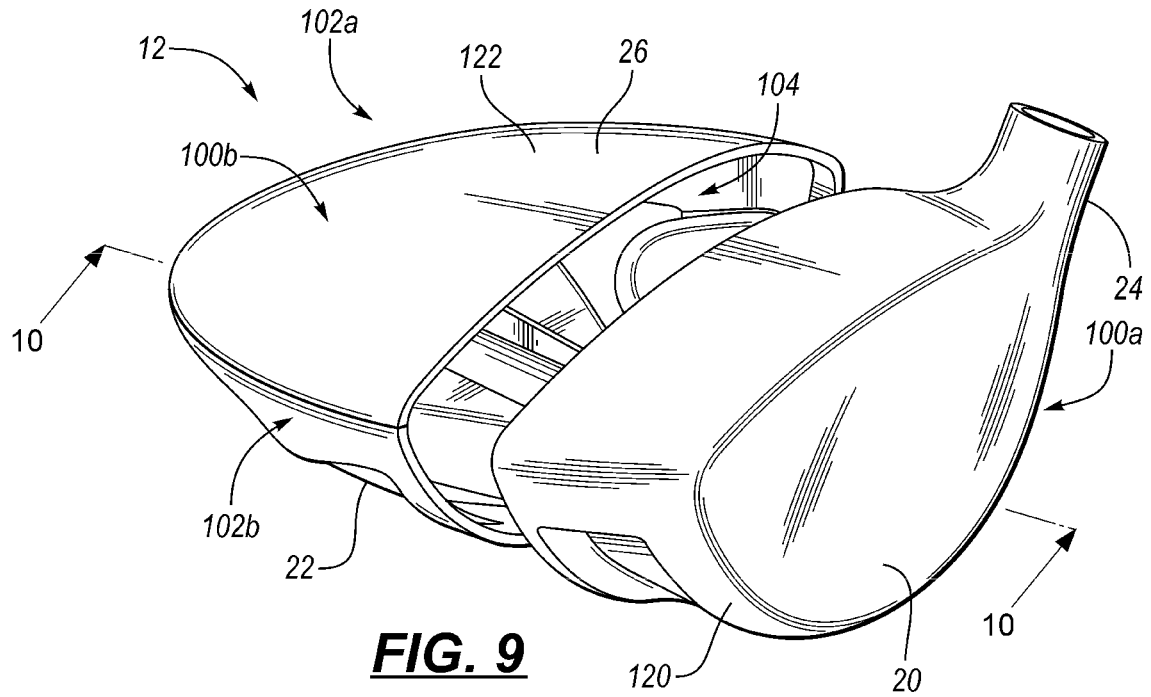
FIG. 9 is a schematic, partially exploded perspective view of a golf club head.
Figure 10:
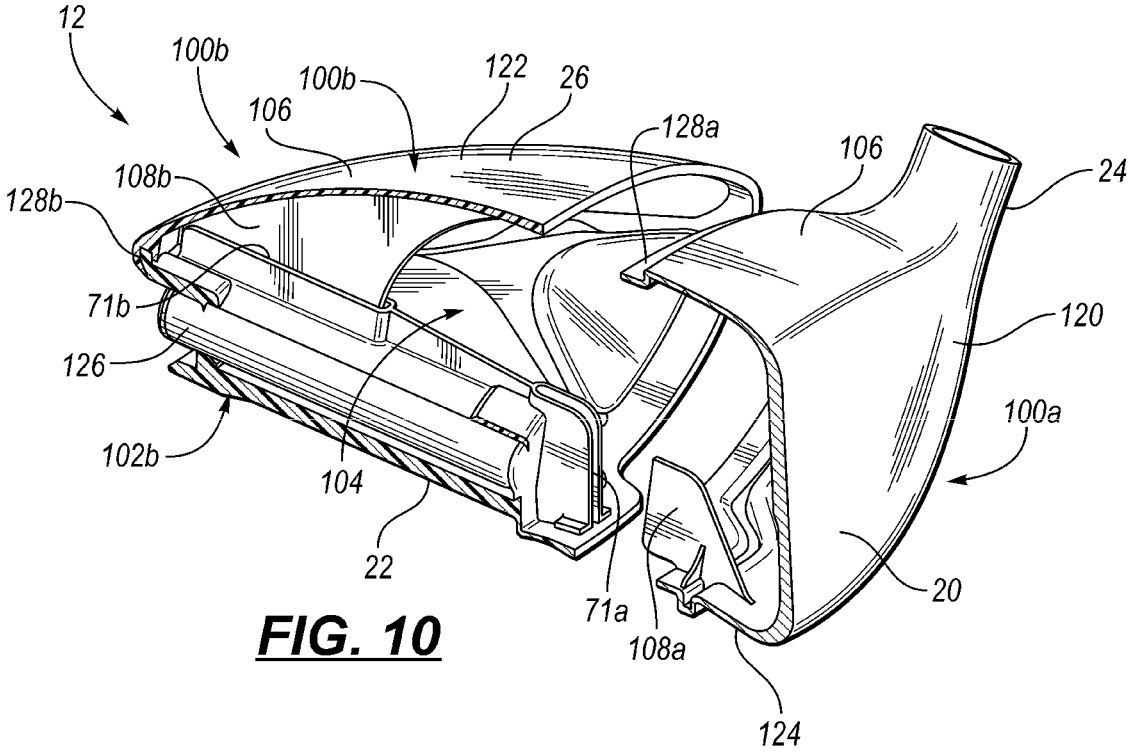
FIG. 10 is a schematic, cross-sectional view of the golf club head of FIG. 9, taken along line 10-10.

While FIGS. 1-8 illustrate a first embodiment of how the present technology may be employed, FIGS. 9-10 schematically illustrate two alternate configurations. In each embodiment (including the embodiment shown in FIGS. 1-8), the golf club head 12 includes a first portion 100 joined to a second portion 102 to at least partially define an interior volume 104 of the club head 12.

The first portion 100 includes a wall 106 that defines an outer boundary of the volume 104 and a support rib or strut (generally at 108) that extends from the wall 106 to operatively stiffen the first portion 100.

The second portion 102 defines a slot 71 that receives a portion of the support rib 108, where the portion of the support rib 108 is then adhered within the slot 71 to aid in joining the first portion 100 to the second portion 102.

In an embodiment, the first portion 100*a* may be a forward section 120 of the golf club head 12 that includes a face 20 and a hosel 24. The second portion 102*b* may then be a rear, body section 122 of the club head 12 that includes the majority of the crown 26 and sole 22. In the illustrated embodiment, the forward section 120 may, for example, be formed from a metallic alloy, while the rear, body section 122 may be formed from a filled or unfilled polymeric material similar to the insert 16 described above.

As shown in FIG. 10, the forward section 120 may include a support rib/strut 108*a* that extends from a sidewall 124 of the forward section 120 in a generally perpendicular manner. The rear, body section 122 of the club head 12 may then include a slot 71*a* that is adapted to receive the support rib 108*a* when the forward section 120 is joined with the rear, body section 122. When assembled, the support rib/strut 108*a* is adhered within the slot 71*a* to facilitate a more robust joint between the forward section 120 and the rear, body section 122.

In this specific embodiment, the support rib/strut 108*a* may be operative to stiffen a portion of the sidewall to alter the impact response of the face 20. Additionally, the rib 108*a* may facilitate an impact force transfer between a weight 126 and the sidewall 124 or face 20.

In another embodiment, also illustrated by FIGS. 9-10, the first portion 100*b* and second portion 102*b* may cooperate to define the rear, body section 122. In this configuration, both portions 100*b*, 102*b* may be formed from the same polymeric material, which may be a filled or unfilled polymeric material similar to the material described above with respect to the insert 16.

As shown, a support rib 108*b* may extend from the crown 26, where it is operative to stiffen and support the crown 26. Due to the crown's polymeric construction, it may be inherently less rigid (absent any buttressing) than a comparable metal crown. Therefore, the reinforcement may be particularly beneficial to achieve a sufficiently thin wall and the desirable weight savings. The second portion 102*b* may include a slot 71*b* that is adapted to receive a portion of the support rib 108*b*, which may be adhered within the slot 71*b* to aid in joining the two halves of the rear section 122.

In each of the embodiments provided in FIGS. 9-10, a lap joint 128*a*, 128*b* may be provided between the first portion 100*a*, 100*b* and the respectively attached portion 102*a*, 102*b*. Adhesive may be provided across the lap joint to further adhere the first portion 100*a*, 100*b* to the respective second portion 102*a*, 102*b*. In each embodiment, the stiffening plane that contains a respective support rib 108 may intersect the respective lap joint 128*a*, 128*b* at an angle of from about 45 degrees to about 135 degrees.

While various embodiments have been described, the description is intended to be exemplary, rather than limiting and it will be apparent to those of ordinary skill in the art that many more embodiments and implementations are possible. For example, while not explicitly shown, the rib/slot arrangements of FIGS. 1-10 may be reversed without departing from the spirit of the present teachings. Likewise, in some embodiments, the support rib 108 may be provided outside of the internal volume 104. Accordingly, the invention is not to be restricted except in light of the attached claims and their equivalents. Also, various modifications and changes may be made within the scope of the attached claims.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club head comprising:

a face, a rear body section, a hosel, a crown, and a sole;

a first portion joined to a second portion to at least partially define an interior club head volume; and a weight that is removably secured to one of the first portion and the second portion;

wherein:

the first portion comprises the face and the hosel;

the second portion comprises the rear body section and a portion of the crown and a portion of the sole;

the first portion comprises a metal alloy and the second portion comprises a polymeric material comprising a resin and a plurality of discontinuous fibers;

wherein the first portion further comprises a support rib that intersects a lap joint at an angle of from 45 degrees to 135 degrees:

the polymeric material comprises a resin content from about 40% to about 90% by weight;

and the second portion is adhered to the first portion across a lap joint.

2. The golf club head of claim 1, wherein the second portion comprises a majority of the crown and a majority of the sole.

3. The golf club head of claim 1, wherein a support rib extends from the crown to support and stiffen the crown.

4. The golf club head of claim 1, wherein the second portion defines a slot that receives a portion of the support rib.

5. The golf club head of claim 1, wherein the resin is a thermoplastic material.

6. The golf club head of claim 1, wherein the plurality of discontinuous fibers are fibers selected from the group consisting of: discontinuous chopped carbon fibers and chopped glass fibers.

7. The golf club head of claim 6, wherein the plurality of discontinuous fibers have lengths from 3 mm to 12 mm.

8. The golf club head of claim 6, wherein the plurality of discontinuous fibers have lengths from 0.01 mm to 3 mm.

9. The golf club head of claim 6, wherein the plurality of discontinuous fibers have an aspect ratio (length/diameter) of greater than 10 and less than 1500.

10. A golf club head comprising:

a body portion comprising a face, a hosel, at least a portion of a sole, and at least a portion of a crown;

an insert portion; and a weight that is removably secured to the body portion;

at least one rib that extends across an opening;

wherein:

the body portion is joined to the insert portion to at least partially define an interior club head volume; and the body portion defines the opening that is adapted to receive the insert portion, such that the insert portion entirely covers the opening;

the opening extends to include both a portion of the crown and a portion of the sole;

the body portion comprises a metal alloy and the insert portion comprises a polymeric material comprising a resin and a plurality of discontinuous fibers;

the polymeric material comprises a resin content from about 40% to about 90% by weight;

and a second portion is adhered to a first portion across a lap joint the weight is an elongated member;

the insert portion comprises a bore configured to receive and retain the elongated member;

the at least one rib is centered about a stiffening plane;

the stiffening plane forms an angle of from about 45 degrees to about 135 degrees with a wall of the body portion from which the at least one rib extends;

wherein:

the weight is also centered about the stiffening plane; and the first portion comprises the face and the hosel and the second portion comprises a rear body section and the portion of the crown and the portion of the sole.

11. The golf club head of claim 10, wherein the at least one rib comprises a rib that is offset from 0 mm to 20 mm from a vertical plane that extends through a center of the face.

12. The golf club head of claim 10, wherein the at least one rib comprises a uniform thickness 64 of from about 0.5 mm to about 1.5 mm.

13. The golf club head of claim 10, wherein the insert portion comprises a majority of the crown.

14. The golf club head of claim 10, wherein the insert portion comprises a majority of the sole.

15. The golf club head of claim 10, wherein the resin is a thermoplastic material.

16. The golf club head of claim 10, wherein:

the plurality of discontinuous fibers are fibers selected from the group consisting of: discontinuous chopped carbon fibers and chopped glass fibers;

the plurality of discontinuous fibers have lengths from 3 mm to 12 mm; and the plurality of discontinuous fibers have an aspect ratio (length/diameter) of greater than 10 and less than 1500.

17. The golf club head of claim 10, wherein:

the plurality of discontinuous fibers are fibers selected from the group consisting of: discontinuous chopped carbon fibers and chopped glass fibers;

the plurality of discontinuous fibers have lengths from 0.01 mm to 3 mm; and the plurality of discontinuous fibers have an aspect ratio (length/diameter) of greater than 10 and less than 1500.

* * * * *